United States Patent [19]

Littleton

[11] 4,088,276

[45] May 9, 1978

[54] TAPE HOLDER AND DISPENSER

[76] Inventor: Gene Littleton, 105 SW. Cabana Pt. Cir., Stuart, Fla. 33494

[21] Appl. No.: 750,291

[22] Filed: Dec. 13, 1976

[51] Int. Cl.[2] ..... B65H 75/38; B65D 85/672

[52] U.S. Cl. ..... 242/55.53; 225/46; 225/53; 225/78; 242/68.3; 242/96; 242/129.71

[58] Field of Search ..... 242/55.53, 96, 84.8, 242/197, 71.1, 68.3, 55.2, 129.7, 129.71, 129.8; 206/402, 409, 411, 407; 225/39, 46, 47, 45, 42, 52, 53, 78

[56] References Cited

U.S. PATENT DOCUMENTS

| | | | |
|---|---|---|---|
| 1,023,587 | 4/1912 | Nederland | 242/55.2 |
| 1,990,135 | 2/1935 | Sato | 242/96 |
| 2,017,570 | 10/1935 | Pollak | 225/42 |
| 2,586,346 | 2/1952 | King | 225/47 |
| 2,683,000 | 7/1954 | Beiderwell | 242/96 |
| 3,217,955 | 11/1965 | Tinkey | 225/47 |
| 3,796,341 | 3/1974 | Berman | 242/55.53 |
| 3,949,947 | 4/1976 | Youngquist et al. | 242/138 |

FOREIGN PATENT DOCUMENTS

| | | | |
|---|---|---|---|
| 1,363,393 | 5/1964 | France | 242/96 |
| 1,954,486 | 6/1970 | Germany | 242/55.53 |

*Primary Examiner*—George F. Mautz
*Attorney, Agent, or Firm*—Jack N. McCarthy

[57] ABSTRACT

A tape holder and dispenser for holding and dispensing tape comprises a cylindrical housing having a closed end with a spindle extending thereto on which a roll of tape can be placed; said cylindrical housing having narrow slots on either side thereof for the free end of a roll of tape to extend therefrom. A tape lock is provided wherein an arcuate section can be moved over the outer surface of the housing to cover a narrow opening and place a force against the tape to hold it in place. A support means is provided on the back of the housing to mount it on a belt, or the like. Arcuate slots are provided on the bottom portions of the housing to provide for rolling back the tape by the use of a finger placed through the opening against the roll of tape. A cover plate is located on the open side of the cylindrical housing which can be snapped into place, and which has an opening therein to aid in removing the cover and viewing the interior of the cylindrical housing to determine the amount of tape left.

4 Claims, 4 Drawing Figures

TAPE HOLDER AND DISPENSER

BACKGROUND OF THE INVENTION

This invention relates generally to the dispensing of tape materials and more particularly to a holding and dispensing device which is strapped around the waist of the user. While the invention finds particular use in air conditioning work where paper backed aluminum duct tape is used, it is understood that the advantages of the invention are also applicable to other fields where there is need for dispensing tape on rolls for application by a user.

While no dispenser appears to be used in the field of air conditioning work, some tape dispensers are shown in the patents set forth hereinafter: U.S. Pat. Nos. 1,990,135; 2,982,491; 3,086,723; 3,326,738 and 3,815,843.

SUMMARY

It is an object of the present invention to provide a tape holder and dispenser which will protect the roll of tape being used and present the free end for easy access by the user.

It is another object of the present invention to provide an apparatus which can be strapped to the waist of the user with means for properly positioning the tape within the holder and means for holding the tape in position so it will not be pulled therefrom inadvertently when not being used.

It is a further object of the invention to provide an apparatus which will center the roll of tape in the holder and provide the proper amount of drag, or resistance to turning, so that the tape will not turn too rapidly around the spindle when it is being used.

It is another object of the invention to provide an apparatus which will prevent waste of tape rolls by permitting the entire roll to be easily used. Usually when the tape is being applied with the roll being hand held, when the roll of tape gets down to a small amount of tape, this will usually not be used since it is too difficult to handle.

It is a further object of the invention to provide an apparatus with finger slots to provide for turning the roll of tape backwards around the spindle until there is just a short piece of tape extending from the dispenser.

It is another object of the invention to provide a tape lock to fix the tape in position when not being used.

DETAILED DESCRIPTION OF THE PREFERRED EMBODIMENT

Figure 1:
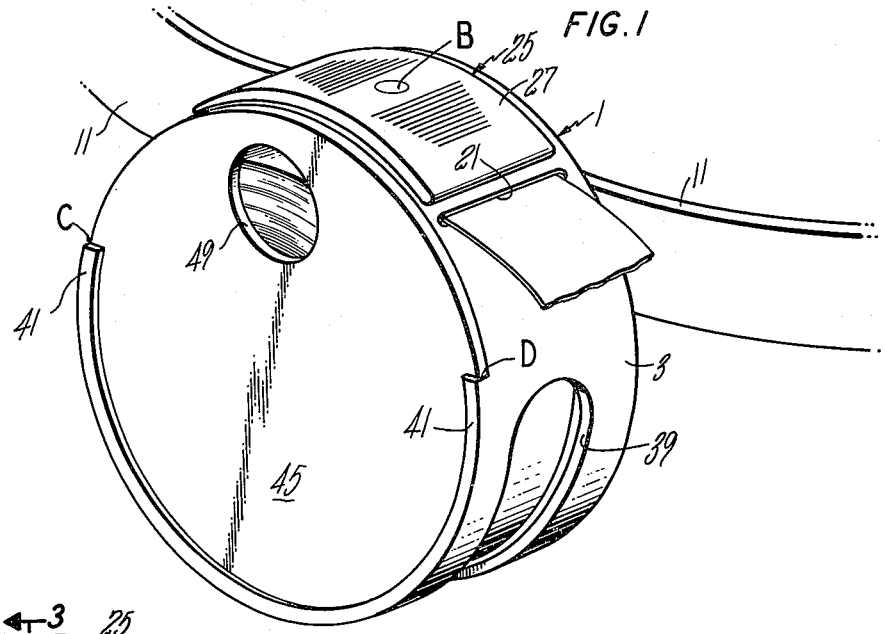
FIG. 1 is a perspective view of the tape holder and dispenser.
Figure 3:
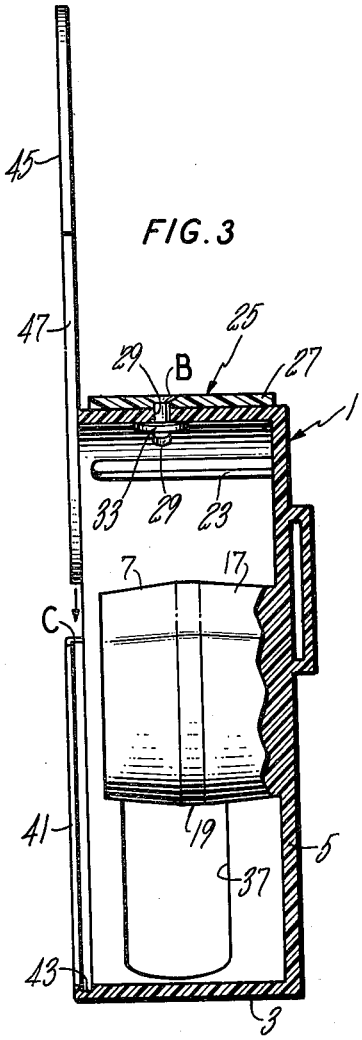
FIG. 3 is a view taken along the line 3—3 of FIG. 2 which is along the axis of tape rotation showing the tape supporting spindle partially in full with the cover in a raised upward position.

In FIG. 1, the tape holder and dispenser 1 is shown as having a cylindrical housing 3 with a closed end and an open end. The closed end is formed by a flat plate 5 with a spindle 7 projecting therefrom into the center part of the cylindrical housing 3. The flat plate 5 can be integrally formed with the cylindrical housing 3 or fixed thereto by bonding, bolting, or any other means desired. The flat plate 5 has support means 9 on the outside thereof for attaching the cylindrical housing 3 to a belt or other device. The support means 9 is shown in FIG. 3 as a slot arrangement through which a belt 11 can be passed. The support means 9 can consist of several small slots in line or one long slot. This support means 9 can also be integrally formed with the flat plate 5 or riveted thereto if desired.

The spindle 7, as stated hereinbefore, projects from the flat plate 5 and extends to a point just short of the open end of the cylindrical housing 3. This spindle 7 can be formed integrally with the flat plate 5 or, here again, as the support means 9, it can be bonded, bolted, or fixed by any other means. The spindle 7 is formed so as to project into the center opening 13 of a roll of tape 15. It can be seen that for different tape holders and dispensers 1, different size spindles 7 can be used.

Figure 2:
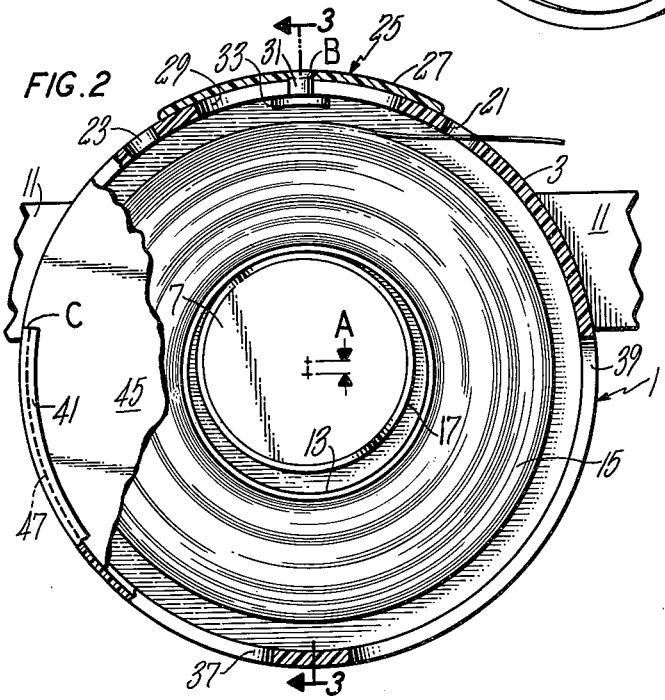
FIG. 2 is a sectional view of the tape holder and dispenser taken through the axis of tape rotation showing a fragment of the cover in position.

However, as shown in FIG. 2, the spindle 7 is positioned with its center offset by the distance A above the center of the cylindrical housing 3 so that the roll of tape 15 will be centered in the cylindrical housing. The outer surface 17 of the spindle 7 is formed with a short cylindrical section 19 at a central portion thereof, with the surfaces on either side tapering inwardly towards the center line of the spindle 7. The width of the cylindrical surface 19 is made of a width which will give the desired amount of drag to a roll of tape 15 so that it will not turn too easily on the spindle. In a construction built, this distance was approximately one-sixth of the width of the roll of tape being used.

Narrow slots 21 and 23, extending for the length of the spindle 7, are located on each side of the cylindrical housing 3 in the mid-portion of each of the upper quadrants to permit tape to be withdrawn from the roll of tape 15 in either direction by either right-handed or left-handed workmen.

A tape lock 25 is located at the top of the cylindrical housing 3 and is formed of an arcuate section 27 which mates with the outer cylindrical surface of the cylindrical housing 3 between the openings 21 and 23. The arcuate section 27 has a width slightly narrower than the cylindrical housing 3 at that point and is guided in a slot 29 located in the top of the cylindrical housing 3 by rivet 31 which has an enlarged head 33 contacting the inner surface of the cylindrical housing 3 so that the rivet 31 cannot be withdrawn from the slot 29. The rivet extends through the arcuate section 27 and is flared outwardly thereover at B. It can be seen that the tape lock 25 in FIG. 2 can be moved to the right, or to the left, to extend over the tape coming out of an opening 21, or 23, to hold the tape against the outer surface of the cylindrical housing 3. The ends of the arcuate section are rounded so as not to tear the tape as it passes thereover. The arcuate section 27 is formed of a material which will permit a deformation thereof outwardly from the connection of the rivet 31 as an end passes over the tape. This action works in both directions and provides a slight biasing action on the tape. In a modification built, the arcuate section was formed of a plastic material which provided the resilience necessary. It can be seen that a metallic section could be formed to provide a similar resilience. If the worker, or user, wishes to unlock the tape lock, he can pull upwardly on the tape against the rounded end of the arcuate section.

Slots 37 and 39, having a width of approximately one-half of the cylindrical housing 3, each extend for approximately the length of each of the lower quadrants of the cylindrical housing 3 to permit the tape to be turned on the spindle 7 by the worker's finger which extends through an opening 37 or 39, depending on whether or not the worker is right-handed or left-handed.

Figure 4:
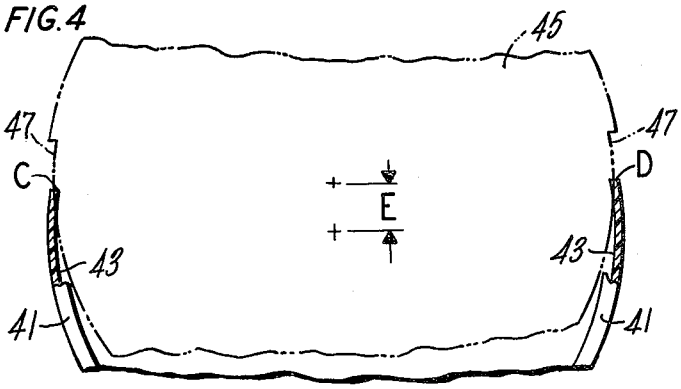
FIG. 4 is a fragmentary view of the tape holder and dispenser with the cover in phantom positioned to show the snap action which holds the cover in place.

The open end of the cylindrical housing 3 is formed having a lip 41 projecting outwardly from the lower portion of the cylindrical housing 3 and extending upwardly to points C and D (see FIG. 4) on each side thereof which is a distance E above the center line of the cylindrical housing 3. This lip 41 has a groove 43 located therein to receive a cover 45. The cover 45 has a diameter equal to the outer surface of the cylindrical housing 3 with a portion of the periphery removed at 47 which fits into the groove 43. It can be seen that the edges of the cover at its diameter of the periphery 47 will provide pressure against the lip 41 at the bottom of the groove 43 at points C and D as the diameter of the cover at that point passes thereby (see phantom lines in FIG. 4). This provides a snap action to hold the cover 45 in place during use. Here again, the material used permits the deformation. In a construction built, a heavy plastic was used. An opening 49 is provided in the top portion of the cover to provide a viewing opening to determine the amount of tape left on the tape roll 15 and will also provide for lifting of the cover by a finger of the user against the snap force provided by the ends C and D of the lip 41.

I claim:

1. A tape holder and dispenser comprising a cylindrical housing, said housing having a closed end and an open end, said closed end having a fixed spindle extending into said cylindrical housing for receiving a roll of tape which can rotate therearound, a first slot extending from adjacent the closed end to adjacent the open end for receiving the free end of a tape therethrough to extend from the interior to the exterior thereof, said cylindrical housing having a second slot extending around the lower periphery of the cylindrical housing through which a user's finger can extend to apply a rotating force to a roll of tape within the cylindrical housing for rolling the tape into said housing around said fixed spindle, an end plate fixed to said cylindrical housing covering the open end of the cylindrical housing, said spindle being fixed to said closed end against rotation and having a short cylindrical section at a center portion thereof, said spindle having surfaces on either side of said short cylindrical section tapering inwardly toward the center line of the spindle, the width of the cylindrical surface providing the desired amount of drag to a roll of tape rotatable thereon so that it will not turn too easily on the spindle.

2. A tape holder and dispenser comprising a cylindrical housing, said housing having a closed end and an open end, said closed end having a fixed spindle extending into said cylindrical housing for receiving a roll of tape which can rotate therearound, a first slot extending from adjacent the closed end to adjacent the open end for receiving the free end of a tape therethrough to extend from the interior to the exterior thereof, said cylindrical housing having a second slot extending around the lower periphery of the cylindrical housing through which a user's finger can extend to apply a rotating force to a roll of tape within the cylindrical housing for rolling the tape into said housing around said fixed spindle, the open end of the cylindrical housing being formed having a lip projecting outwardly from the lower portion of the cylindrical housing to locations a short distance above the center line of the cylindrical housing, said lip having a groove located therein in line with the open end of the cylindrical housing, a cover plate for covering the open end of the cylindrical housing, said cover plate having a portion of its periphery at a radius which is the radius of the cylindrical housing while the lower portion has a radius which is the radius of the inner portion of the groove, said cover plate being snapped in a closed position by the squeezing of the ends of the lip against the periphery of the lower portion of the cover plate at its diameter as it slides downwardly into the groove.

3. A tape holder and dispenser comprising a cylindrical housing, said housing having a closed end and an open end, said closed end having a fixed spindle extending into said cylindrical housing for receiving a roll of tape which can rotate therearound, a first slot extending from adjacent the closed end to adjacent the open end for receiving the free end of a tape therethrough to extend from the interior to the exterior thereof, said cylindrical housing having a second slot extending around the lower periphery of the cylindrical housing through which a user's finger can extend to apply a rotating force to a roll of tape within the cylindrical housing for rolling the tape into said housing around said fixed spindle, an end plate fixed to said cylindrical housing covering the open end of the cylindrical housing, the center of the spindle being offset from the center of the cylindrical housing to center a roll of tape which is loosely mounted thereon in the cylindrical housing.

4. A tape holder and dispenser as set forth in claim 1 wherein the center of the spindle is offset from the center of the cylindrical housing to center a roll of tape which is loosely mounted thereon in the cylindrical housing.

* * * * *